US005706699A

United States Patent [19]

Moribayashi

[11] Patent Number: 5,706,699

[45] Date of Patent: Jan. 13, 1998

[54] STARTER MOTOR WITH INTERMEDIATE GEAR

[75] Inventor: Satoshi Moribayashi, Hyogo, Japan

[73] Assignee: Mitsubishi Denki Kabushiki Kaisha, Tokyo, Japan

[21] Appl. No.: 747,742

[22] Filed: Nov. 12, 1996

Related U.S. Application Data

[63] Continuation of Ser. No. 386,764, Feb. 10, 1995.

[30] Foreign Application Priority Data

Apr. 20, 1994 [JP] Japan ..... 6-106076

[51] Int. Cl.[6] ..... F02N 11/10; F02N 15/06

[52] U.S. Cl. ..... 74/7 A; 74/7 E

[58] Field of Search ..... 74/7 A, 7 E, 7 R; 403/315, 335, 336; 290/38 C, 38 R

[56] References Cited

U.S. PATENT DOCUMENTS 4,974,463 12/1990 Luiki ..... 74/7 A
5,130,586 7/1992 Miyaji et al. ..... 74/7 E X
5,165,293 11/1992 Kittaka et al. ..... 74/7 A
5,251,499 10/1993 Isozumi ..... 74/7 E
5,258,674 11/1993 Sakamoto et al. ..... 310/83
5,265,485 11/1993 Sakamoto et al. ..... 74/7 E
5,277,075 1/1994 Sakamoto et al. ..... 74/7 E X

FOREIGN PATENT DOCUMENTS 4-19667 2/1992 Japan .

*Primary Examiner*—Rodney H. Bonck
*Assistant Examiner*—Troy Grabow
*Attorney, Agent, or Firm*—Sughrue, Mion, Zinn, Macpeak & Seas, PLLC

[57] ABSTRACT

A starter motor with an intermediate gear includes a retaining member free from being deformed or damaged due to the centrifugal force induced by the high-speed revolution of the intermediate gear of a starter motor driven by the ring gear of an engine. The retaining member is used to prevent a movable coupling for coupling an overrunning clutch and the intermediate gear from axially slipping out. A flange-like retaining member **67*b* for preventing the movable coupling 68 from axially slipping out is integrally formed on the diametral outside of the end portion of the boss 67*a* of the intermediate gear 67**.

6 Claims, 8 Drawing Sheets

STARTER MOTOR WITH INTERMEDIATE GEAR

This is a Continuation of application No. Ser. 08/386,764 filed Feb. 10, 1995.

BACKGROUND OF THE INVENTION

The present invention relates to a starter motor with an intermediate gear. More particularly, it relates to an interlocking means to cause the movement of the intermediate gear when an overrunning clutch is moved.

FIG. 16 is an elevational view of a conventional starter motor with an intermediate gear as disclosed in, for example, Japanese Utility Model Publication Hei-4-19667/(1992), with a sectional view of the principal part thereof. In FIG. 16, reference numeral 31 denotes a direct-current motor in which a rotary shaft 33 is extended from an armature 32, and a sun gear 43 with a pinion is formed on the frontend outer periphery of the rotary shaft 33. Further, reference numeral 35 denotes a front bracket which combines the yoke of a direct-current motor 31.

Further, reference numeral 36 denotes an electromagnetic switch fitted to the front bracket 35. The upper end portion of a shift lever 20 is coupled to the front end portion of a plunger 37 and the shift lever 20 is turned on its central pivot. Reference numeral 38 denotes a rubber grommet fitted into the front bracket 35 to support the pivot.

Further, reference numeral 40 denotes a planetary reduction gear having the following parts: an internal gear frame 41 fixed to the front bracket 35 and provided with an internal gear 42 on its inner periphery; and a plurality of planetary gears 44 which revolve on their respective axes while meshing with the sun gear 43 and also revolve round the latter, the planetary gears 44 being supported via a bearing (not shown) by a support pin 48 secured to a flange 47 formed on a relay shaft 46. Thus the rotation of the relay shaft 46 is reduced while the planetary gears 44 revolve round the sun gear 43.

The rear end of the relay shaft 46 is supported by the internal gear frame 41 via a bearing 49, whereas its front end is supported by the front bracket 35 via a sleeve bearing 5, and a helical spline (shown in FIG. 17) is formed on the rearward outer periphery of the relay shaft 46.

Further, reference numeral 50 denotes an overrunning clutch fitted to the relay shaft 46 as shown in FIG. 17; 51, a clutch outer engaging with the helical spline 46*a* of the relay shaft 46 to which the reduced torque is transmitted; 52, a clutch inner for transmitting one-way torque to the clutch outer 51 via a roller 10, the clutch inner 52 being axially movably supported by the relay shaft 46 via a sleeve bearing 17. A pinion is integrally formed in the front end portion of the clutch inner 52 and when the pinion is moved forward, it is stopped by a stopper 18 (FIG. 16). In this case, a clutch cover 12 is secured by caulking to the clutch outer 51 via a patch 13. Reference numeral 54 denotes a mating ring fitted into the clutch outer 51 and secured with a snap ring 55. A mating groove 56 is formed in between the annular retaining portion 54a of the mating ring 54 and the stepped portion of the clutch outer 51, and the lower ends of the forked portion of the shift lever 20 are fitted into the mating groove 56. The front end portion of the rotary shaft 33 of the armature is supported with a support opening at the rear end of the relay shaft 46 via a bearing 60 and a steel ball 61 is added thereto in the axial direction.

Referring to FIG. 16 again, reference numeral 65 denotes a support shaft secured to the front bracket 35 in parallel to the front bracket 35 and prevented from slipping out by means of a snap ring 66; 67, an intermediate gear supported rotatably and slidably by the support shaft 65 via a sleeve bearing (not shown) secured to the inner periphery thereof, the intermediate gear 67 engaging with the pinion 53 and thereby receiving the torque therefrom; and 68, a movable coupling which is prevented from slipping out by means of a snap ring 69 loosely fitted to the outer periphery of the boss 67*a* of the intermediate gear 67, the movable coupling 68 having an arm 68*b* axially extending from the boss 68*a*, and provided with an arcuate mating member 68*c* on one end of the movable coupling 68. FIG. 18 is an elevational view of the movable coupling 68, wherein the arcuate mating member 68*c* is to be inserted into the mating groove 56 of the overrunning clutch from beneath.

The operation of the starter motor will subsequently be described. When the electromagnetic switch 36 is supplied with power and energized, the shift lever 20 is turned counterclockwise so as to move the overrunning clutch 50 forward in the direction of A and the movable coupling 68 interlocked therewith moves the intermediate gear 67 forward and also engages the intermediate gear 67 with a ring gear 30. Simultaneously, the fixed contacts of the electromagnetic switch 36 are closed and the circuit of the starter motor 31 thus supplied with power causes the armature 32 to rotate. Consequently, the rotation of the rotary shaft 33 of the armature is reduced by the planetary reduction gear 40 and the rotation of the relay shaft 46 is reduced, whereby the ring gear 30 is then rotated via the overrunning clutch 50 and the relay shaft 46. An internal combustion engine is thus started.

When a key switch is turned off after the internal combustion engine is started, the power supplied to the electromagnetic switch 36 is cut off, and the reset spring within the electromagnetic switch 36 allows the plunger 37 to be reset. Then the shift lever 20 is turned clockwise to cause the overrunning clutch 50 to move back, whereby the movable coupling 68 interlockingly moves back the intermediate gear 67 and releases the intermediate gear 67 from meshing with the ring gear 30. Simultaneously, the fixed contacts of the electromagnetic switch 36 are opened, so that the supply of power to the starter motor 31 is suspended with the effect of stopping the armature 32 from rotating.

The starter motor is thus constructed and when the speed of revolutions of the engine increases in such a state that the intermediate gear has been engaged with the ring gear, the intermediate gear revolves at high speed since the gear ratio between the intermediate gear and the ring gear normally ranges from roughly 5 to 10. The snap ring 69 for preventing the movable coupling 68 from axially slipping out as shown in FIG. 19A is deformed due to the centrifugal force induced by the revolution of the intermediate gear so that its front ends outwardly expand as shown in FIG. 19B. When the snap ring 69 is urged back by the movable coupling, however, it comes out and the problem is that the movable coupling may also come out of the intermediate gear.

SUMMARY OF THE INVENTION

An object of the present invention made to solve the foregoing problems is to provide a reliable starter motor with an intermediate gear so designed that its movable coupling is prevented from coming out of the boss of the intermediate gear as a result of the missing of a snap ring.

A starter motor with an intermediate gear according to the present invention is such that a flange-like retaining member for axially retaining a movable coupling is provided at the outer periphery of the end portion of the boss of an intermediate gear as an integral part thereof. Therefore, the retaining member is prevented from being deformed due to the centrifugal force induced by the revolution of the intermediate gear.

Further, a starter motor with an intermediate gear according to the present invention is such that a member for preventing a snap ring member from expanding is provided to the diametral outside of the snap ring member via a small clearance. Therefore, the snap ring member is prevented from slipping out due to the centrifugal force induced by the revolution of the intermediate gear.

DETAILED DESCRIPTION OF PREFERRED EMBODIMENTS

Embodiment 1

Figure 1:
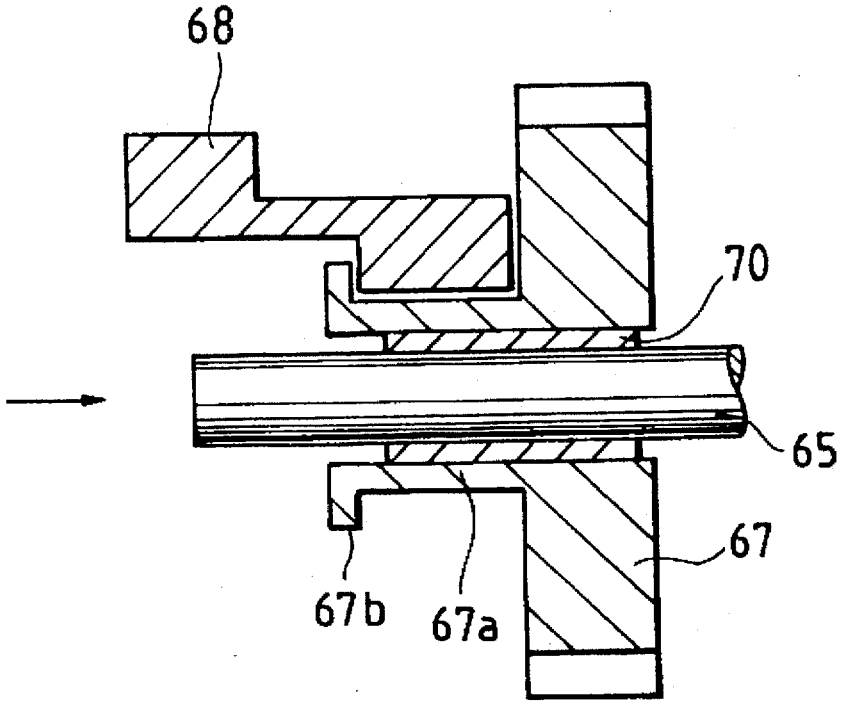
FIG. 1 is a sectional view of the principal part of a starter motor with an intermediate gear as a first embodiment of the present invention.
Figure 2:
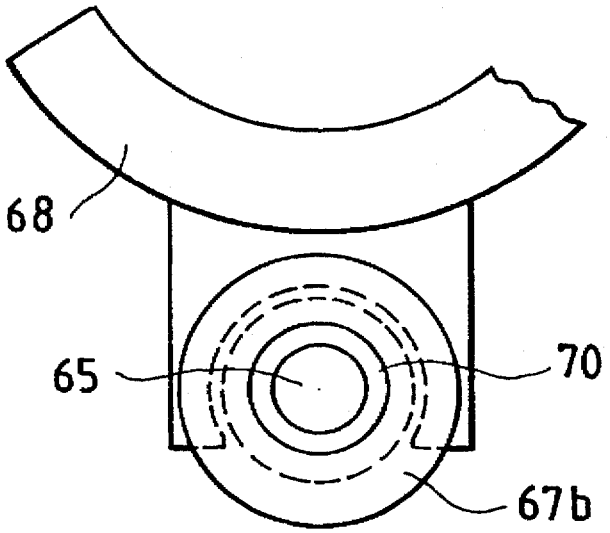
FIG. 2 is a side view taken in the direction of an arrow in FIG. 1.
Figure 3:
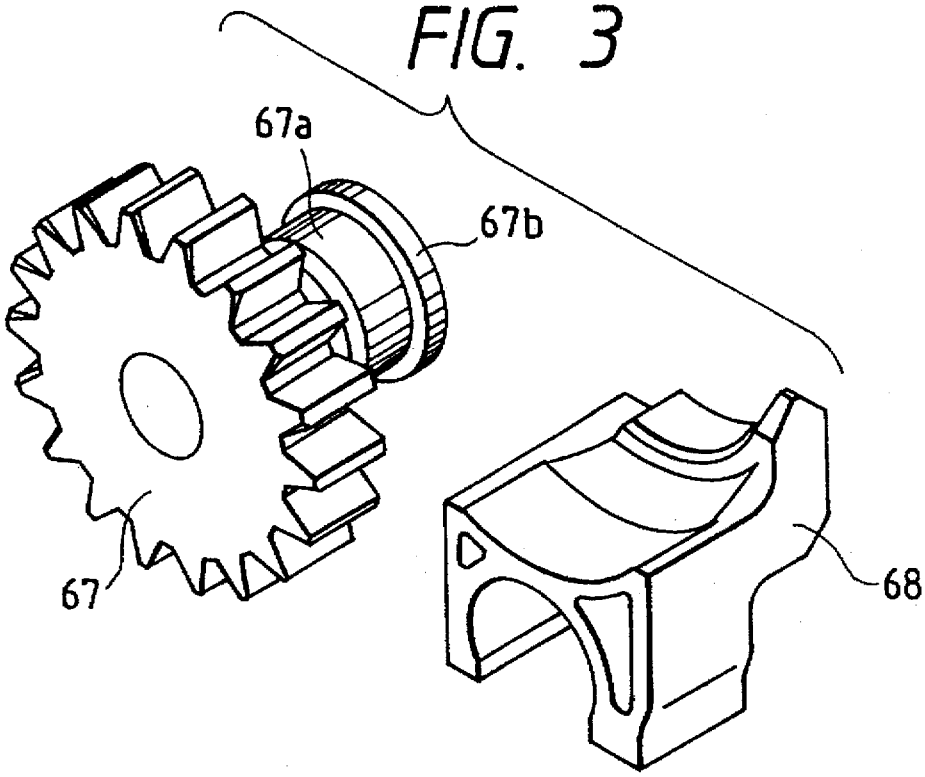
FIG. 3 is a perspective view of an intermediate gear and a movable coupling according to the first embodiment of the present invention.

FIG. 1 is a sectional view of the principal part of a starter motor with an intermediate gear as a first embodiment of the present invention, FIG. 2 a side view taken in the direction of an arrow in FIG. 1, and FIG. 3 an exploded perspective view of an intermediate gear and a movable coupling. In these drawings, reference numeral 67*b* denotes a flange extended from the end portion of the boss 67*a* of an intermediate gear 67 as an integral part of the intermediate gear 67 and serves to prevent a movable coupling 68 from backwardly slipping out. Reference numeral 70 denotes a sleeve bearing secured to the inner periphery of the intermediate gear 67.

More specifically, the aforementioned conventional snap ring 69 is replaced with the flange 67*b* and with this arrangement, the flange 67*b* will be set free from deformation or destruction even if it is subject to centrifugal force resulting from the high-speed revolution of the intermediate gear 67 since it is formed as an integral part of the intermediate gear 67. Consequently, the movable coupling 68 is prevented from slipping out even when the flange 67*b* is urged back by the movable coupling 68.

The following effects are achieved by the arrangement above.

(a) As a snap ring can be dispensed with, the number of parts is reduced to the extent that the manhours required to assemble parts into the snap ring are curtailed.

Figure 4:
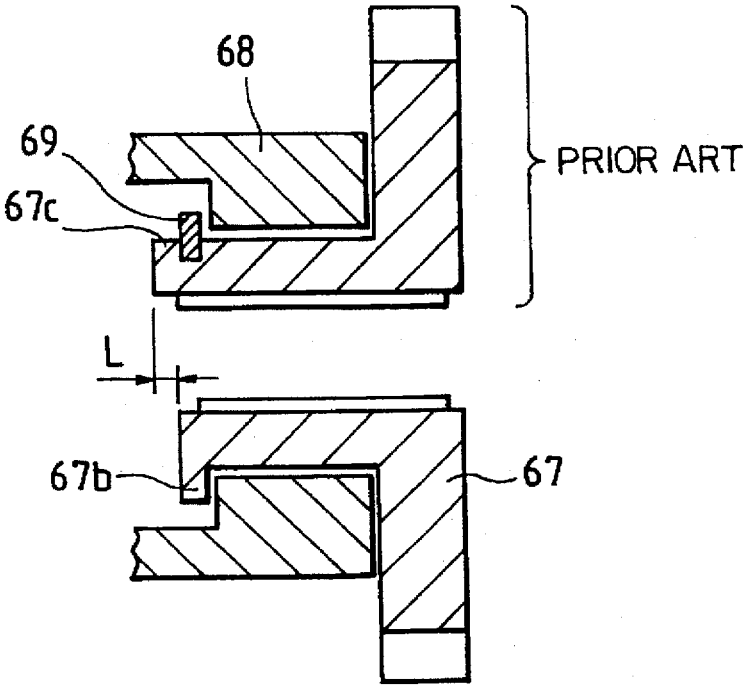
FIG. 4 is a diagram illustrating the comparison between the shaft length of a conventional intermediate gear and that of a movable coupling embodying the present invention.

(b) As shown in the upper section of FIG. 4, the conventional snap ring type necessitates an additional small boss member 67*c* in the rear. The flange type according to the present invention makes it unnecessary to provide such a rear boss member as shown in the lower section thereof. Thus the length of the shaft of the intermediate gear can be shortened.

(c) Moreover, it is certainly assured to prevent the movable coupling 68 from slipping out.

(d) In addition, it is unnecessary to machine a snap ring groove.

As the remaining arrangement is similar to that of the conventional starter motor, the description thereof will be omitted.

Although a description has been given of a case where the planetary reduction gear 40 is added according to this embodiment, the present invention is still applicable to a case where the rotary shaft of the armature is extended up to the front end portion of the front bracket so as to omit the planetary reduction gear.

Embodiment 2

Figure 5:
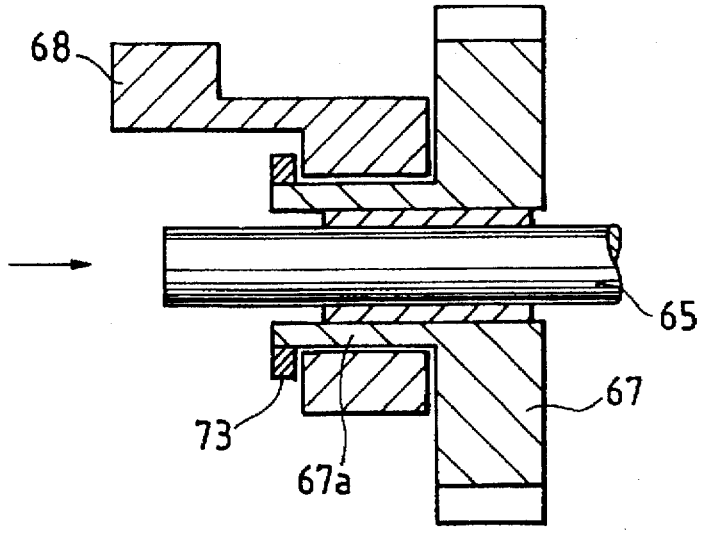
FIG. 5 is a sectional view of the principal part of another starter motor with an intermediate gear as a second embodiment of the present invention.
Figure 6:
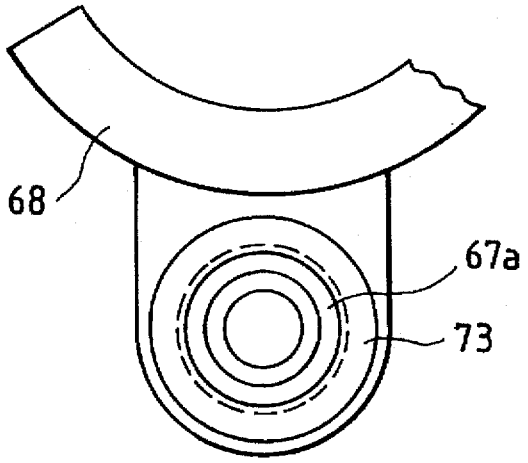
FIG. 6 is a side view taken in the direction of an arrow in FIG. 5.
Figure 7:
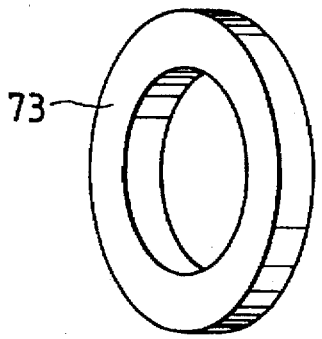
FIG. 7 is a perspective view of a retaining member in the second embodiment of the present invention.

FIG. 5 is a sectional view of the principal part of another starter motor with an intermediate gear as a second embodiment of the present invention, FIG. 6 a side view taken in the direction of an arrow in FIG. 5, and FIG. 7 a perspective view of only a retaining member. In FIG. 5, reference numeral 73 denotes a ring-like retaining member for preventing the movable coupling 68 from slipping out, the retaining member being secured onto the end portion of the boss 67*a* of the intermediate gear 67; in this case, the retaining member 73 may be secured thereto by press-fitting, welding, bonding, caulking or shrink-fitting. While the retaining member 73 is thus secured firmly and integrally, the intermediate gear 67 is revolved at high speed. As the retaining member 73 is set free from deformation or damage due to centrifugal force, not only the retaining member but also the movable coupling is prevented from slipping out even when the former is urged back by the movable coupling. Consequently, the same effects enumerated in Embodiment 1 will be achieved.

Embodiment 3

Figure 8:
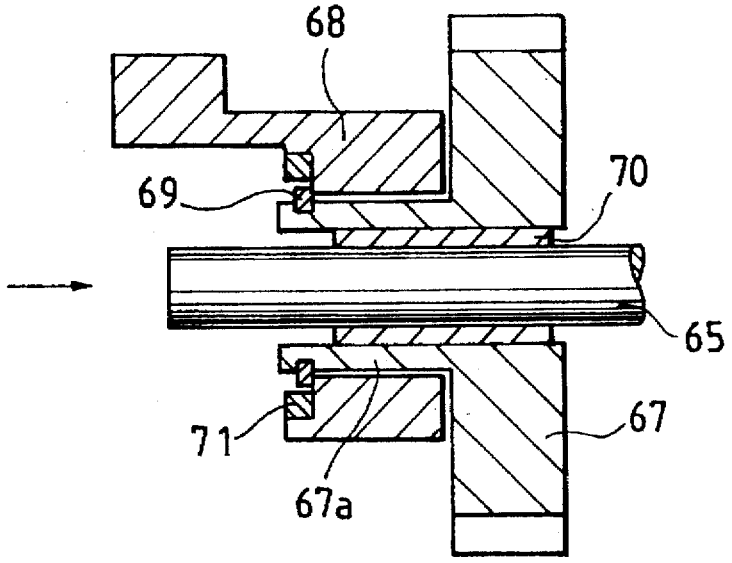
FIG. 8 is a sectional view of the principal part of a third embodiment of the present invention.
Figure 9:
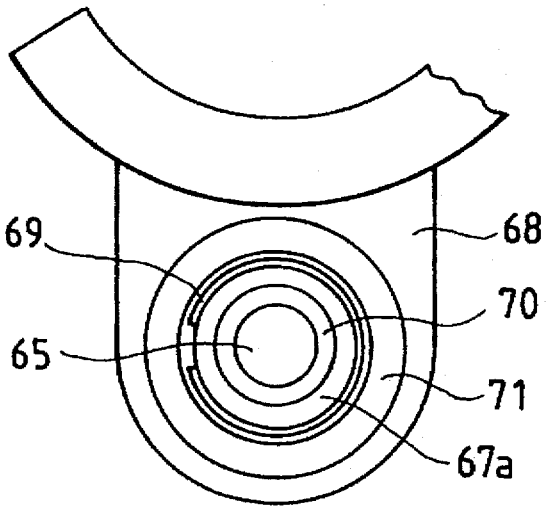
FIG. 9 is a side view taken in the direction of an arrow in FIG. 8.
Figure 10:
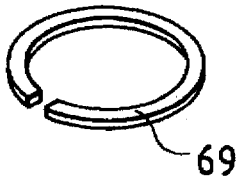
FIG. 10 is a perspective view of a snap ring in the third embodiment.
Figure 11:
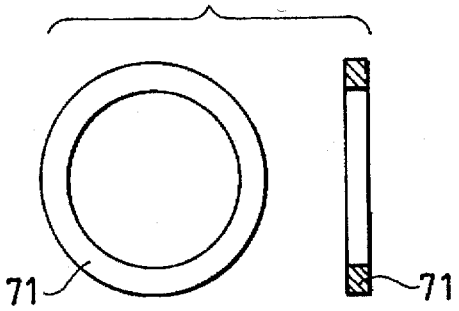
FIG. 11 is an elevational and a sectional view of a ring member in the third embodiment of the present invention.

FIGS. 8 through 11 inclusive, show a third embodiment of the present invention. FIG. 8 is a sectional view of the fabricated principal part, FIG. 9 a side view taken in the direction of an arrow in FIG. 8, FIG. 10 is a perspective view of a snap ring, and FIG. 11 is an elevational and a sectional view of a ring member.

In these drawings, reference numeral 69 denotes the snap ring 69 fitted close to the end portion of the boss 67*a* of intermediate gear 67; and numeral 71 denotes a ring member secured to the movable coupling 68 and used for preventing the snap ring 69 from expanding.

As stated above, the snap ring 69 is restrained by the ring member 71 from expanding even when the intermediate gear 67 rotates fast enough to cause the snap ring 69 to expand due to the centrifugal force thus generated. The snap ring 69 is firmly fixed to the snap ring groove of the boss 67*a* and consequently will not slip out even though it is urged back by the movable coupling 68.

The ring member 71 may be secured to the movable coupling 68 by press-fitting, welding, bonding, caulking or shrink-fitting. In a case where a plastic movable coupling 68 is employed, the ring member 71 may be formed as an integral part thereof.

The ring member 71 is installed with a clearance between the inner periphery of ring member 71 and the outer periphery of the snap ring 69 and the clearance is set sufficient to allow the snap ring 69 to expand to the extent that it will not come out even if it is expanded before being urged back by the movable coupling 68.

Moreover, it is preferable for the material of the snap ring to be as hard as or harder than the snap ring 69 lest the snap ring 69 wears even if it rubs against the snap ring 69 rotating at high speed.

Embodiment 4

Figure 12:
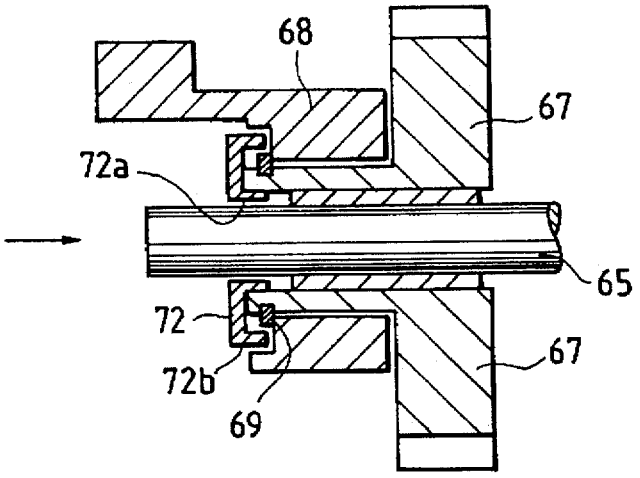
FIG. 12 is a sectional view of the principal part of a fourth embodiment of the present invention.
Figure 13:
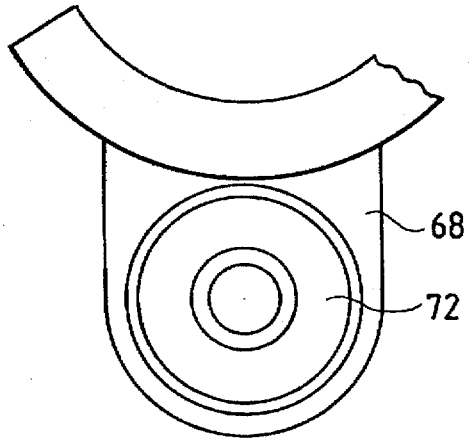
FIG. 13 is a side view taken in the direction of an arrow in FIG. 12.
Figure 14:
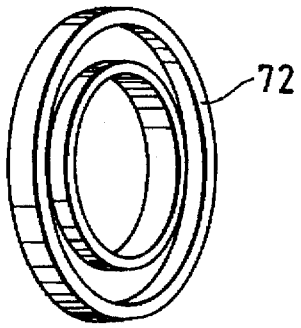
FIG. 14 is a perspective view of a ring member in the fourth embodiment of the present invention.

FIGS. 12 through 14 inclusive, show a fourth embodiment of the present invention. FIG. 12 is a sectional view of the fabricated principal part, FIG. 13 a side view taken in the direction of an arrow in FIG. 12, and FIG. 14 a perspective view of a ring member. In FIG. 12, reference numeral 72 denotes a U-shaped ring member in cross section. An extension 72*a* extending axially on the inner diameter side is secured to the inner diameter of the boss 67*a* of the intermediate gear 67 and an extension 72*b* on the outer diameter side is installed close to the outer periphery of the snap ring 69 fitted close to the end portion of the intermediate gear 67 so as to prevent the snap ring 69 from expanding.

The ring member 72 may also be secured by press-fitting, welding, bonding, caulking or shrink-fitting.

Even when the ring member 72 is not fit for forming as an integral part of the movable coupling 68 made of plastics or otherwise hardly secured thereto, a ring member 72 offering relatively greater rigidity may be employed with the effect of preventing the snap ring from expanding further according to this embodiment of the invention since the ring member 72 is secured to the inner periphery of the boss 67*a*.

The clearance and the material of the ring member defined in the third embodiment also applies to this case.

Embodiment 5

Figure 15:
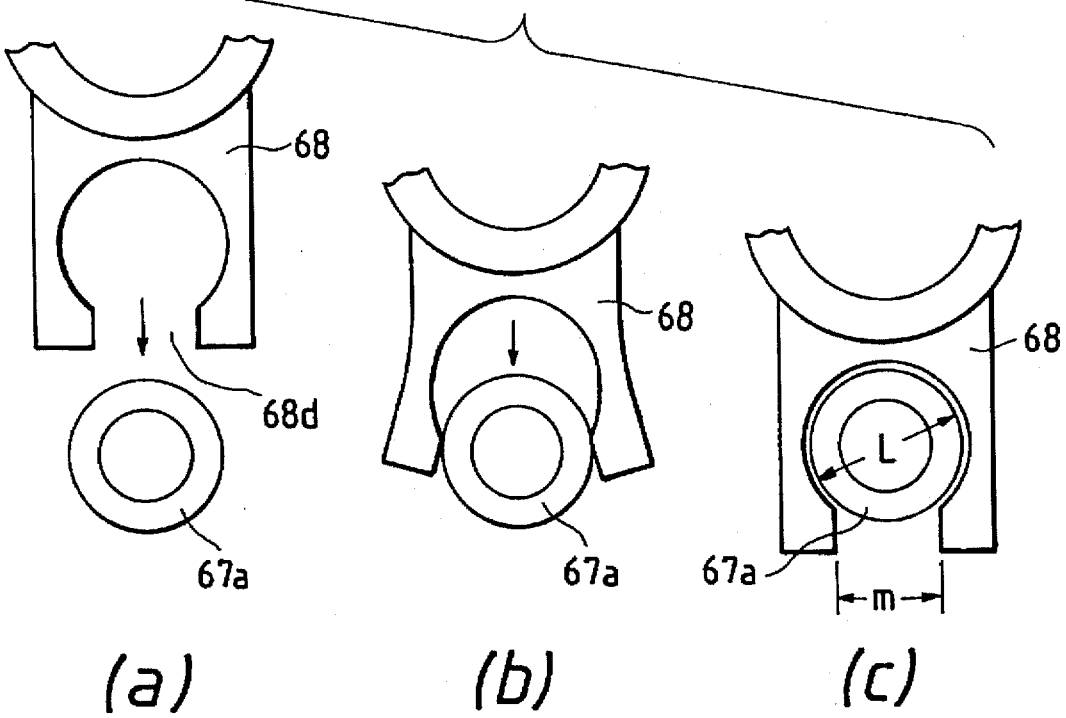
FIG. 15*a* shows the movable coupling and boss of the intermediate gear prior to fitting of the coupling to the boss in the fifth embodiment of the present invention.
FIG. 15*b* shows the movable coupling and boss of the intermediate gear during fitting of the coupling to the boss in the fifth embodiment of the present invention.
FIG. 15*c* shows the movable coupling and boss of the intermediate gear after fitting of the coupling to the boss in the fifth embodiment of the present invention.
Figure 16:
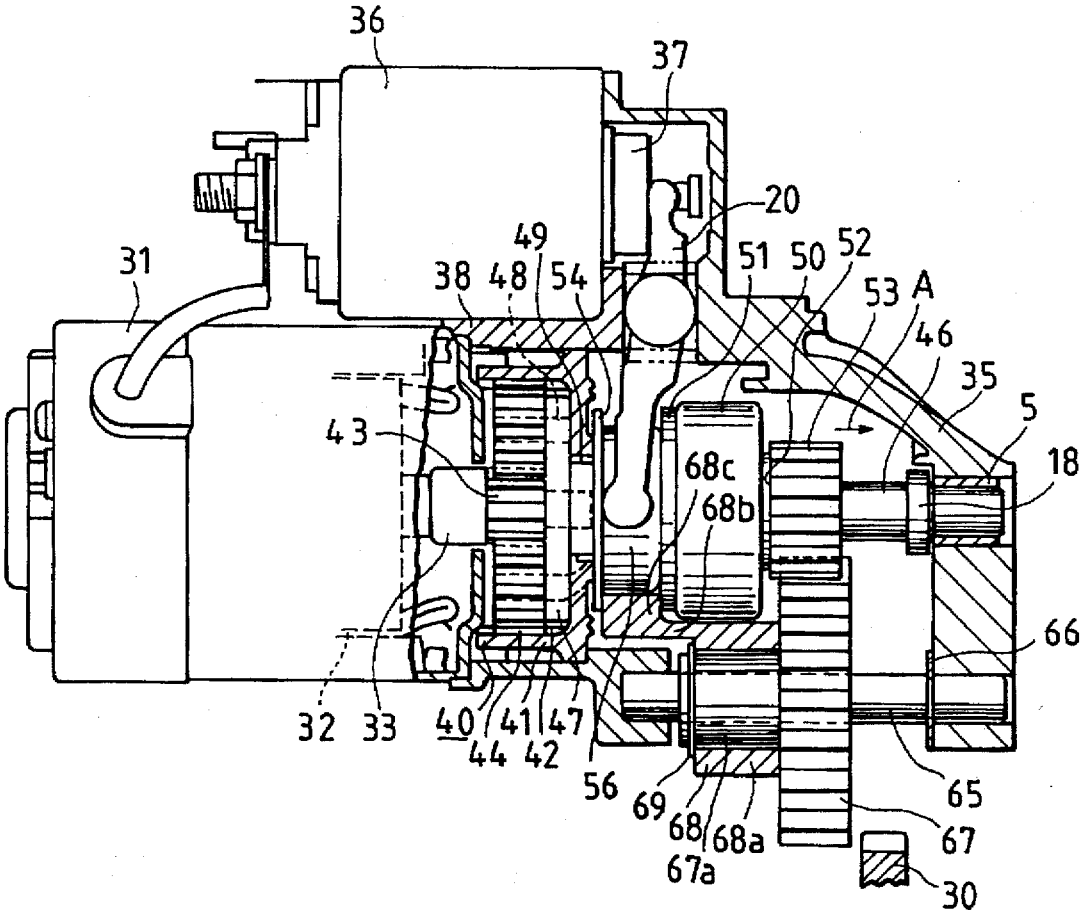
FIG. 16 PRIOR ART
FIG. 16 a partial sectional of a conventional starter motor with an intermediate gear.
Figure 17:
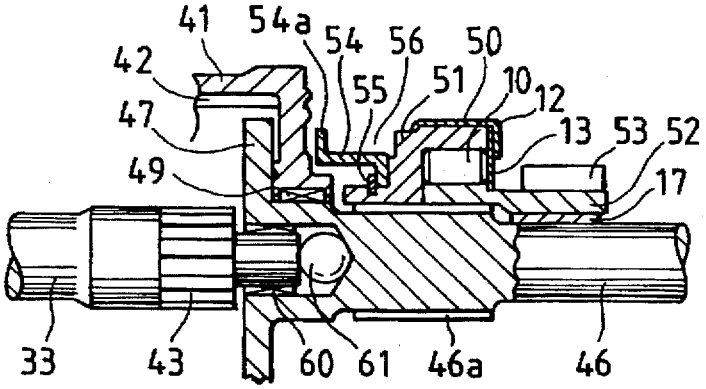
FIG. 17 PRIOR ART
FIG. 17 is a sectional view of an overrunning switch of FIG. 16.
Figure 18:
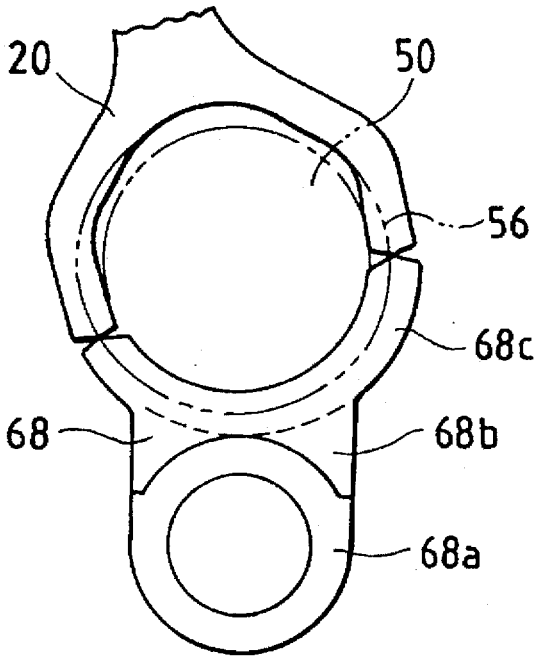
FIG. 18 PRIOR ART
FIG. 18 is an elevational view of a conventional movable coupling.
Figure 19A:
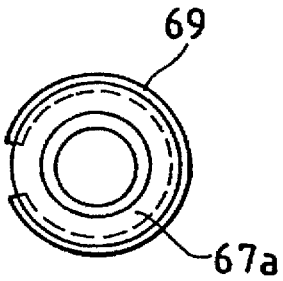
FIG. 19A PRIOR ART
FIG. 19A is an elevational view of the principal part wherein a snap ring has been fitted to a boss.
Figure 19B:
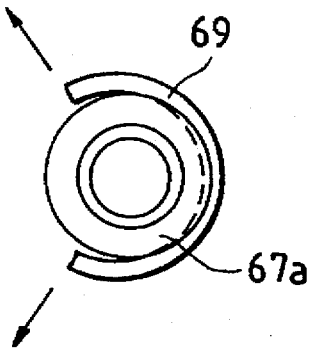
FIG. 19B PRIOR ART
FIG. 19B is an elevational view of the principal part wherein the leading ends of the snap ring have expanded.

FIG. 15 shows a procedure for fitting the movable coupling to the boss of the intermediate gear according to the present invention.

An opening 68*d* for use in fitting the movable coupling 68 to the boss 67*a* of the intermediate gear is provided for the intermediate gear 67 and the opening is fitted to the boss of the intermediate gear from the outside in the diametral direction (a)-(b)-(c) as shown by arrows. At this time, the spring action of the coupling parts with respect to the boss can be utilized by setting the width (m) of the opening smaller than the outer diameter (L) of the boss.

When the fitting of the movable coupling is completed, the relation of L>m prevents the movable coupling from coming out of the boss in the diametral direction and the intermediate gear as well as the flange 67*b* also prevents the movable coupling from axially coming out as shown in FIG. 1.

As set forth above, the provision of the flange-like retaining member for axially retaining the movable coupling to be integrally fitted to the outer periphery of the end portion of the boss of the intermediate gear according to the present invention prevents the retaining member from being deformed due to the centrifugal force induced by the revolution of the intermediate gear. Therefore, there is not the slightest fear of causing the movable coupling to come out of the boss of the intermediate gear.

According to the present invention, further, the member for preventing the snap ring from expanding is positioned outside of the snap ring member via the small gap, so that the retaining member is prevented from being deformed due to the centrifugal force induced by the revolution of the intermediate gear.

What is claimed is:

1. A starter motor with an intermediate gear, comprising:

an overrunning clutch engaged with a helical spline formed on an output shaft of a motor for transmitting a one-way revolution by a revolution of the output shaft, said overrunning clutch being slidable in forward and rearward directions;

a pinion coupled to said overrunning clutch and rotated in a direction of the one-way revolution;

an intermediate support shaft substantially parallel to the output shaft;

an intermediate gear rotatably and slidably held by said intermediate support shaft to transmit the torque of said pinion to a ring gear of an internal combustion engine;

a movable coupling member having a retaining member with an inner circumferential surface that mates with a boss of said intermediate gear, said inner circumferential surface extending more than half way, but less than all of the way, around the boss, said movable coupling member being engaged with said overrunning clutch; and a flange extending continuously around the circumference of a front-end outer periphery of the boss of the intermediate gear for retaining the movable coupling member in an axial direction of the boss, whereby said flange is free from deformation due to the centrifugal force induced by the revolution of the intermediate gear.

2. A starter motor with an intermediate gear as claimed in claim 1, wherein said flange is integrally formed with the front-end outer periphery of the boss of the intermediate gear.

3. A starter motor with an intermediate gear as claimed in claim 1, wherein said flange comprises a ring shaped member formed separately from the boss, said ring shaped member being fixedly secured to the front-end outer periphery of the boss.

4. A starter motor with an intermediate gear as claimed in claim 3, wherein said ring shaped member is fixedly secured to the front-end outer periphery of the boss by one of press-fitting, welding, bonding, caulking and shrink-fitting.

5. A starter motor with an intermediate gear as claimed in claim 1, wherein said retaining member has two arm portions that define said inner circumferential surface of said retaining member, said two arm portions partially surround the boss, and said two arm portions are flexible to a degree sufficient to permit the retaining member to be fitted to the boss in a diametral direction of the boss.

6. A starter motor with an intermediate gear as claimed in claim 5, wherein a gap is formed between distal ends of said two arm portions, and a width of said gap is less than the diameter of the boss.

* * * * *